US010029475B2

(12) United States Patent
Suzuki et al.

(10) Patent No.: US 10,029,475 B2
(45) Date of Patent: Jul. 24, 2018

(54) RECORDING HEAD AND INKJET RECORDING APPARATUS

(71) Applicant: CANON KABUSHIKI KAISHA, Tokyo (JP)

(72) Inventors: Fumiko Suzuki, Kawasaki (JP); Hirokazu Tanaka, Inagi (JP); Tsukasa Doi, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/681,073

(22) Filed: Aug. 18, 2017

(65) Prior Publication Data

US 2018/0050544 A1 Feb. 22, 2018

(30) Foreign Application Priority Data

Aug. 22, 2016 (JP) ..... 2016-161918

(51) Int. Cl.

| | |
|---|---|
| ***B41J 19/14*** | (2006.01) |
| ***B41J 2/21*** | (2006.01) |
| ***B41J 2/045*** | (2006.01) |

(52) U.S. Cl.

CPC ..... *B41J 2/2103* (2013.01); *B41J 2/04508* (2013.01); *B41J 2/04586* (2013.01); *B41J 2/2132* (2013.01); *B41J 19/142* (2013.01); *B41J 19/147* (2013.01)

(58) Field of Classification Search

CPC ..... B41J 2/2103; B41J 19/147; B41J 19/142; B41J 2/04508; B41J 2/04586; B41J 2/2132

See application file for complete search history.

(56) References Cited

U.S. PATENT DOCUMENTS

| | | | | |
|---|---|---|---|---|
| 7,377,619 | B2 * | 5/2008 | Takahashi | B41J 2/15 347/43 |
| 7,690,763 | B2 * | 4/2010 | Nakano | B41J 2/145 347/43 |
| 2004/0051756 | A1 | 3/2004 | Takenaka | |
| 2009/0174741 | A1 * | 7/2009 | Nagata | B41J 2/1752 347/12 |

FOREIGN PATENT DOCUMENTS

| | | | |
|---|---|---|---|
| JP | 2002154240 | A | 5/2002 |
| JP | 2010046904 | A | 3/2010 |
| WO | 2006/123528 | A1 | 11/2006 |

* cited by examiner

*Primary Examiner* — Yaovi M Ameh

(74) *Attorney, Agent, or Firm* — Canon U.S.A., Inc. IP Division

(57) ABSTRACT

A light blue ink discharge opening array unit is located between cyan ink discharge opening array units, between the magenta ink discharge opening array units, and not between the black ink discharge opening array unit.

18 Claims, 11 Drawing Sheets

| SCAN DIRECTION | | FORWARD SCAN | BACKWARD SCAN |
|---|---|---|---|
| INK DISCHARGE ORDER | | Color2 → Color1 | Color1 → Color2 |
| IMAGE OF LANDING | DOTS ARE NOT SUPERIMPOSED |   |   |
| | DOTS ARE SUPERIMPOSED |   |   |

RECORDING HEAD AND INKJET RECORDING APPARATUS

BACKGROUND OF THE INVENTION

Field of the Invention

The present invention relates to recording heads and inkjet recording apparatuses.

Description of the Related Art

Conventional inkjet recording apparatuses are known that employ a recording head provided with a plurality of discharge opening array units including discharge opening arrays in which plurality of discharge openings for discharging ink arranged. In the inkjet recording apparatuses, while the recording head performs forward and backward scans with respect to a recording medium, ink is discharged to form an image on the recording medium.

It is known that in such an inkjet recording apparatus configured to perform forward and backward scans, a color in a region recorded forward scan on a recording medium can differ from a color in a region recorded a backward scan on the recording medium, and the color difference can cause image quality deteriorations. The color difference will be described in detail below focusing only on black and yellow inks. In a case of using a recording head that includes only one black ink discharge opening array unit and one yellow ink discharge opening array unit, black and yellow inks are applied in this order to a region recorded by one of forward and backward scans, whereas yellow and black inks are applied in this order to a region recorded by the other one of the forward and backward scans. The difference in the order of application of inks between the forward and backward scans causes a color difference between the forward and backward recorded regions.

To solve this issue, Japanese Patent Application Laid-Open No. 2010-046904 discusses a recording head including a plurality of discharge opening array units arranged to reduce the color difference between the forward and backward recorded regions described above. Specifically, in FIG. 9 in Japanese Patent Application Laid-Open No. 2010-046904, one yellow ink discharge opening array unit and two black ink discharge opening array units are provided, and the black ink discharge opening array units and the yellow ink discharge opening array unit are arranged symmetrically. Use of such a recording head enables application of black, yellow, and black inks in this order in both forward and backward scans to reduce a color difference between the forward and backward recorded regions.

Further, many conventional inkjet recording apparatuses use inks of four colors in total including basic colors (three primary colors), which are cyan, magenta, and yellow, and a black ink. However, in recent years, use of an ink of another color depending on the purpose in addition to the inks of four colors has been known. For example, when cyan and magenta inks having a low lightness are applied in a superimposing manner onto a recording medium to reproduce a blue hue, a problem arises that an image with notable graininess is recorded. The problem of graininess is solved by using a light cyan ink and a light magenta ink each having substantially the same hue as the hues of cyan and magenta and having a higher lightness. However, use of the inks of two colors in addition to the inks of four colors leads to an increase in apparatus size and costs. Japanese Patent Application Laid-Open No. 2002-154240 discusses use of a light blue ink having a hue between the hues of cyan and magenta and having a higher lightness than the lightness of cyan and the lightness of magenta. Use of the light blue ink enables recording with less visible graininess in the blue hue, which is easily visually recognizable, without an increase in apparatus size and costs.

However, when the discharge opening array unit for discharging the light blue ink discussed in Japanese Patent Application Laid-Open No. 2002-154240 is further added in the recording head discussed in Japanese Patent Application Laid-Open No. 2010-046904 which the discharge opening array units for the inks of different colors are arranged symmetrically, a problem described below arises.

First, a case in which only one light blue ink discharge opening array unit is arranged will be described below. In order to reduce a color difference between the forward and backward recorded regions described above, it is desirable to arrange the light blue ink discharge opening array unit between two black ink discharge opening array units. This arrangement enables application of black, light blue, and black inks in this order in both forward and backward scans.

However, in the above-described arrangement, the distance between the two black ink discharge opening array units for the black ink, which has the lowest lightness among the colors, becomes relatively long. This can cause a problem that image quality deteriorations are visible when the recording head is attached at a tilt to the recording apparatus or when scans performed by the recording head are tilted.

For example, when the recording head in which the discharge opening array units of black, yellow, and black inks are arranged in this order as illustrated in FIG. 9 in Japanese Patent Application Laid-Open No. 2010-046904 further includes the light blue ink discharge opening array unit arranged as described above, not only the yellow ink discharge opening array unit but also the light blue ink discharge opening array unit is located between the two black Ink discharge opening array units. The increase in the number of discharge opening array units located between the two black ink discharge opening array units results in an increase in the distance between the black ink discharge opening array units.

The greater the distance between the two discharge opening array units is, the more significant the deviation of ink landing positions becomes when the recording head is attached at a tilt to the recording apparatus or when scans performed by the recording head are tilted. A deviation of landing positions of the black ink, which has the lowest lightness, causes a more significant deterioration in image quality than those of other color inks. Thus, if the light blue ink discharge opening array unit is arranged between the two black ink discharge opening array units and increases the distance between the discharge opening array unit for the black ink, which has the lowest lightness, a deviation of ink landing positions can cause a significant deterioration in image quality.

If two light blue ink discharge opening array units are provided and two black ink discharge opening array units are arranged between the two light blue ink discharge opening array units, the distance between the two black ink discharge opening array units is decreased while the black and light blue inks are applied in the same order in both forward and backward scans. However, providing two discharge opening array units when one discharge opening array unit is sufficient can cause an unnecessary increase in the size of the recording head.

SUMMARY OF THE INVENTION

The present invention is directed to a recording head capable of reducing a color difference between forward and backward scans while reducing image quality deteriorations resulting from deviations of ink landing positions.

According to an aspect of the present invention, a recording head includes a plurality of discharge opening array units arranged side by side and including at least two first discharge opening array units for discharging an ink of a first color, two second discharge opening array units for discharging an ink of a second color, a third discharge opening array unit for discharging an ink of a third color, and two fourth discharge opening array units for discharging an ink of a fourth color, wherein $h1<h3<h2$, $L3>L1>L4$, and $L3>L2>L4$ are satisfied, where h1 is a hue angle of the first color, L1 is a lightness of the first color, h2 is a hue angle of the second color, L2 is a lightness of the second color, h3 is a hue angle of the third color, L3 is a lightness of the third color, and L4 is a lightness of the fourth color, wherein the third discharge opening array unit is the only discharge opening unit, among the plurality of discharge opening array units, for discharging the ink of the third color, and wherein the plurality of discharge opening array units is arranged in such a manner that the one third discharge opening array unit is located between the two first discharge opening array units, between the two second discharge opening array units, and not between the two fourth discharge opening array units.

Further features of the present invention will become apparent from the following description of exemplary embodiments with reference to the attached drawings.

DESCRIPTION OF THE EMBODIMENTS

A first exemplary embodiment of the present invention will be described in detail below with reference to the drawings.

Figure 1:
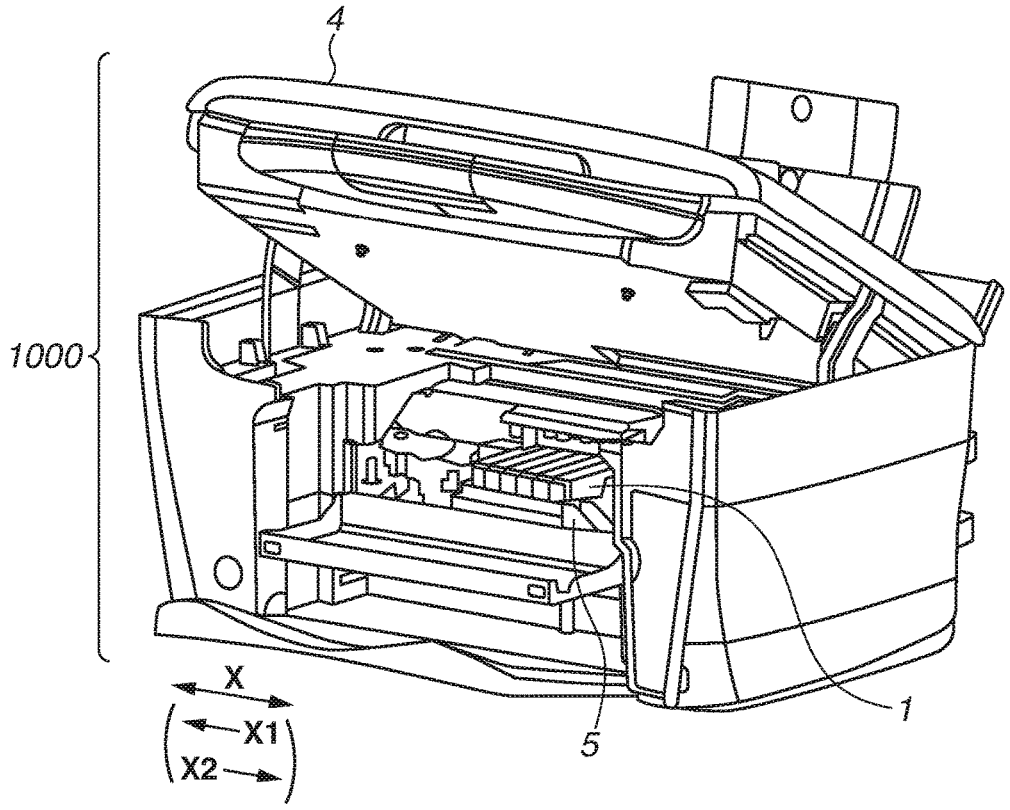
FIG. 1 is a perspective view illustrating an image recording apparatus according to a first exemplary embodiment.

FIG. 1 schematically illustrates an internal configuration of an inkjet recording apparatus 1000 according to the present exemplary embodiment. In FIG. 1, the inkjet recording apparatus 1000 with an upper cover opened is illustrated.

The inkjet recording apparatus (hereinafter, sometimes referred to also as "printer" or "recording apparatus") 1000 according to the present exemplary embodiment includes a carriage 5 which is moved forward and backward (performs forward and backward scans) along an X-direction (intersecting direction). On the carriage 5 is mounted a recording head 1 described below. In the present exemplary embodiment, the moving speed (scan speed) of the carriage 5 and the recording head 1 is approximately 25 inches/second. While the carriage 5 and the recording head 1 are moved forward and backward, ink is discharged from the recording head 1 to record an image onto a recording medium.

The recording medium is fed from a sheet feeding tray of the printer 1000 and conveyed in a sub-scan direction which intersects with the X-direction. In the present exemplary embodiment, a recording medium is conveyed at approximately 5 inches/second.

In the present exemplary embodiment, the scans by the recording head 1 and the conveying of a recording medium are repeated alternately as described above to complete recording on the single sheet of recording medium. In the present exemplary embodiment, either one of a one-pass recording method, in which recording on a unit region on a recording medium is completed by a single scan, and a multi-pass recording method, in which recording on a unit region is completed by a plurality of scans, can be used.

Further, the thickness of a sheet used in the present exemplary embodiment is approximately 0.3 mm, and in this case, the distance between the recording head 1 and the sheet in a height direction is approximately 1.0 mm. An upper portion of the printer 1000 includes a scanner 4 for scanning an image to be recorded. The scanner 4 is integrated with an upper cover of the printer 1000.

Figure 2:
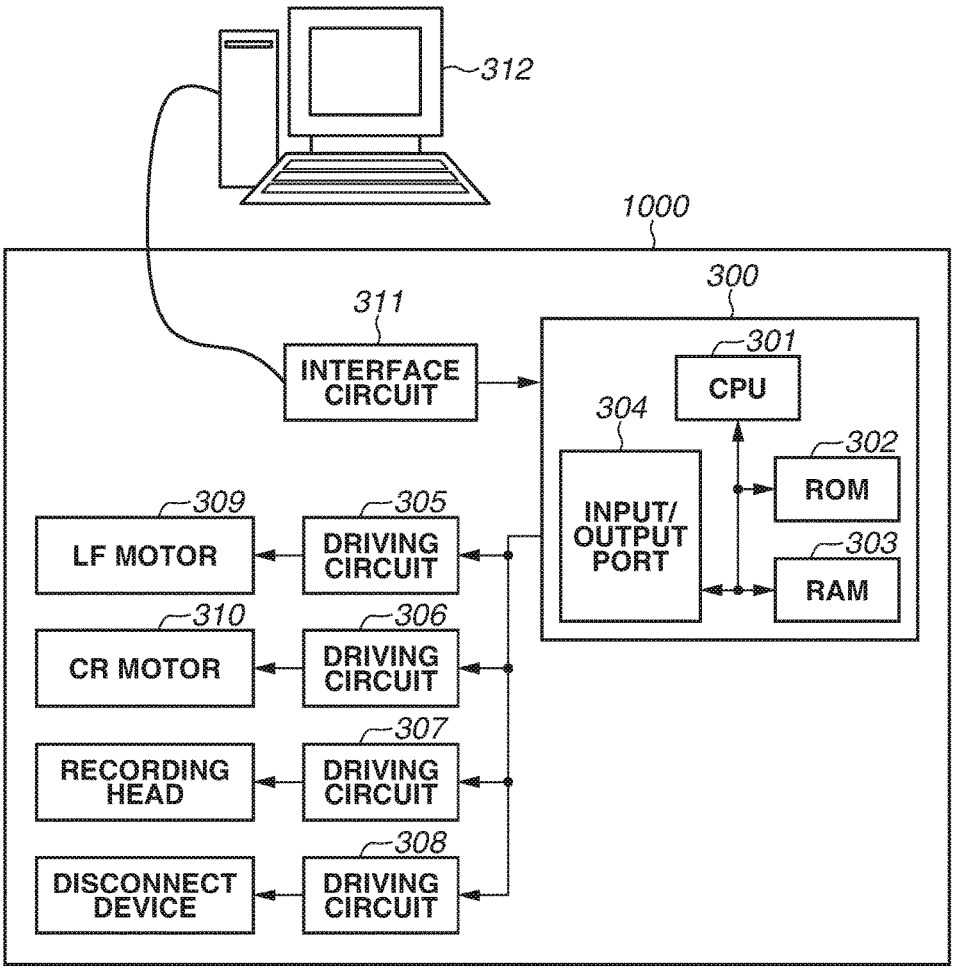
FIG. 2 schematically illustrates a recording control system according to the first exemplary embodiment.

FIG. 2 is a block diagram schematically illustrating the configuration of a control system in the printer 1000 according to the present exemplary embodiment. A main control unit 300 includes a central processing unit (CPU) 301, a read-only memory (ROM) 302, a random access memory (RAM) 303, and an input/output port 304. The CPU 301 executes processing such as calculation, selection, determination, and control. ROM 302 stores control programs, etc. to be executed by the CPU 301. The RAM 303 is used as a buffer, etc. for recording data. Further, the ROM 302 also stores mask patterns, etc. described below. The input/output port 304 is connected to driving circuits 305, 306, 307, and 308 for respectively driving a conveying motor (LF motor) 309, a carriage motor (CR motor) 310, the recording head 1, and an actuator of a disconnect device for disconnecting a recording medium, etc. Further, the main control unit 300 is connected to a personal computer (PC) 312, which is a host computer, via an interface circuit 311.

(Data Generation Processing)

Figure 3:
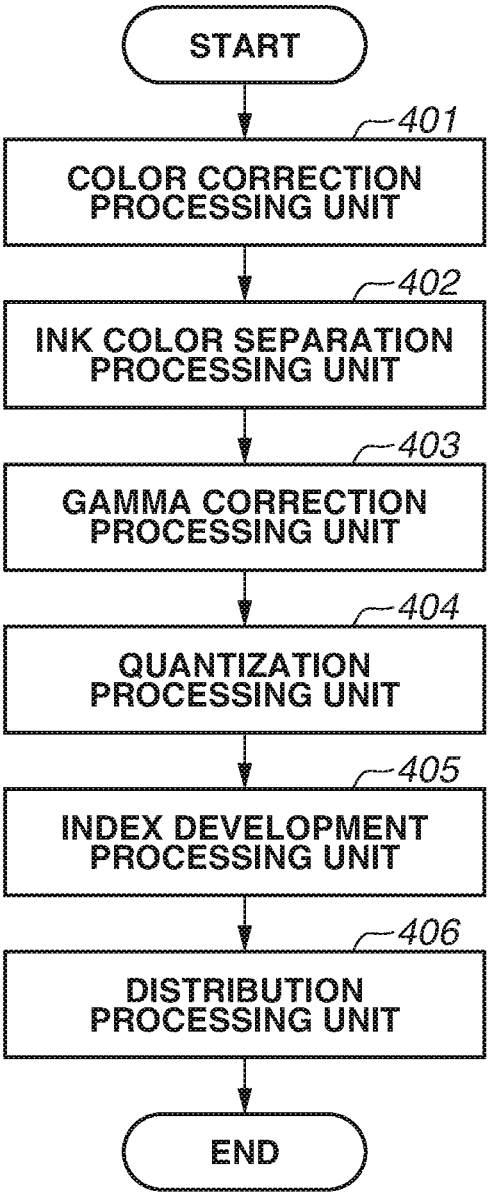
FIG. 3 illustrates a process of data processing according to the first exemplary embodiment.

FIG. 3 is a flow chart illustrating a process of generating recording data for use in recording executed by the CPU 301 according to a control program in the present exemplary embodiment. The control program is stored in advance in the ROM 302.

Input image data is red-green-blue (RGB) signals of eight bits per color which has a resolution of 600 dpi and 256 gradations per pixel. The data is first transmitted to a color correction processing unit 401 to undergo processing for associating a color space expressed by the host PC 312, such as a standard RGB (sRGB) color space, with a color space that can be expressed by the printer 1000. Specifically, 8-bit, 256-value RGB signals are converted into 8-bit, 256-value RGB signals by referencing a three-dimensional look-up table (LUT) stored in advance in the ROM 302.

Next, an ink color separation processing unit 402 converts data generated by the color correction processing unit 401 into data corresponding to ink colors used by the recording apparatus 1000. Specifically, 8-bit, 256-value RGB signals are converted into 8-bit density signals of the respective ink colors by referencing a three-dimensional LUT stored in advance in the ROM 302.

The separated data of each ink color is input to a gamma correction processing unit 403, and density value correction is performed for each ink color. Gamma correction is a correction performed so that densities of input data and optical densities of an image expressed on a recording medium have a linear relationship. Specifically, 8-bit, 256-value density data of each ink color is converted into 8-bit, 256-value density data by referencing a one-dimensional LUT stored in advance in the ROM 302.

Thereafter, a quantization processing unit 404 performs quantization processing on the 8-bit, 256-value density data of each ink color to generate 2-bit, 4-value quantized data of each ink color. In the present exemplary embodiment, a method for the quantization processing is not particularly limited, and a dither method, an error diffusion method, etc. can be used.

Next, the quantized data is transmitted to an index development processing unit 405 and converted into 1-bit binary data. Specifically, an index pattern that defines the number and positions of ink to be discharged with respect to 2 pixels×2 pixels=4 pixels according to values of quantized data for one pixel group including 2 pixels×2 pixels is used to generate binary data which defines whether to discharge or not discharge each ink with respect to each pixel. The index pattern is stored in advance in the ROM 302.

Thereafter, the binary data is transmitted to a distribution processing unit 406, and binary data is distributed to a plurality of scans with respect to a unit region. Specifically, 1-bit binary recording data for use in a plurality of scans is generated for each of the scans using a plurality of mask patterns corresponding to the plurality of scans and defining whether to discharge or not discharge ink with respect to each pixel. The plurality of mask patterns is stored in advance in the ROM 302. Further, the case of the recording using the single-pass recording method, the processing of the distribution processing unit 406 is omitted.

While the foregoing describes that the CPU 301 in the printer 1000 executes the processing of every one of the units 401 to 406, a CPU (not illustrated) in the PC 312 can execute some or all of the processing of the units 401 to 406.

(Hue and Brightness of Ink)

In the present exemplary embodiment, recording is performed using a light blue ink in addition to cyan, magenta, yellow, and black inks.

The light blue ink used in the present exemplary embodiment has a relatively high lightness (low density) and a relatively close hue to a blue hue reproduced by a mixture of equal amounts of cyan and magenta inks. Specifically, the light blue ink used in the present exemplary embodiment satisfies the conditions that the hue of the light blue is between the hues of the cyan and magenta inks and the lightness of the light blue is higher than the lightness of the cyan ink and the lightness of the magenta ink.

Use of the light blue ink that satisfies the above-described conditions enables reproduction of the blue hue without superimposing the cyan and magenta inks in the recording of a low-density (inks are discharged in small amounts) image. This enables recording of an image with less graininess in the blue hue.

Hereinafter, the hue angles of the cyan, magenta, light blue, black, and yellow inks will be denoted by h1, h2, h3, h4, and h5, respectively, and the lightnesses of the cyan, magenta, light blue, black, and yellow inks will be denoted by L1, L2, L3, L4, and L5, respectively. The hue angles and lightnesses of the respective color inks used in the present exemplary embodiment are shown in (Table 1).

TABLE 1

| | h | L |
|---|---|---|
| Cyan | h1 = 228 | L1 = 63 |
| Magenta | h2 = 348 | L2 = 61 |
| Light Blue | h3 = 299 | L3 = 68 |
| Black | h4 = 229 | L4 = 36 |
| Yellow | h5 = 92 | L5 = 90 |

From (Table 1) it is understood that the light blue ink used in the present exemplary embodiment satisfies the conditions that the hue angle h3 of the light blue is between the hue angle h1 of the cyan ink and the hue angle h2 of the magenta ink and the lightness L3 of the light blue is higher than the lightness L1 of the cyan ink and the lightness L2 of the magenta ink.

(How Respective Color Inks are Used)

The following describes how the respective color inks are used.

Figure 4A:
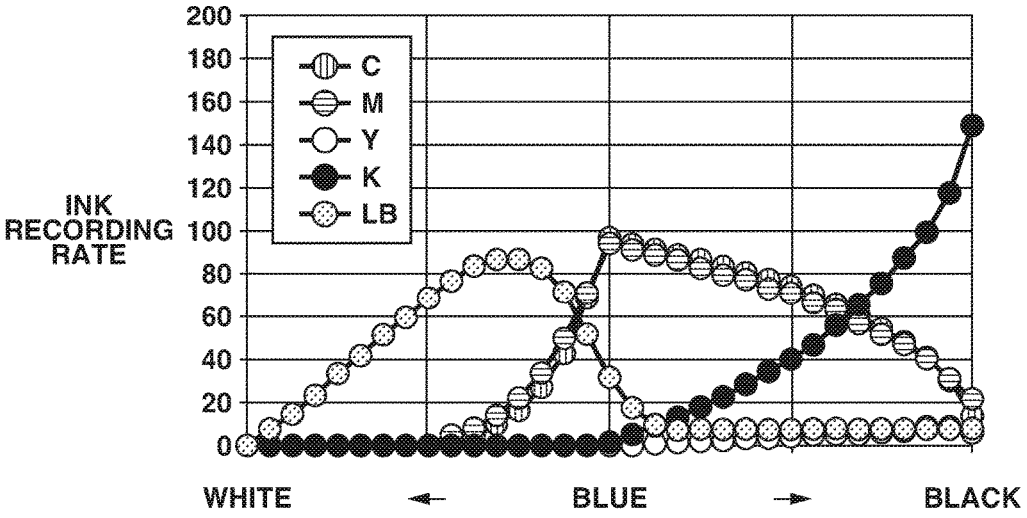
FIGS. 4A and 4B illustrate ink recording rates in respective density gradations according to the first exemplary embodiment.

FIG. 4A illustrates the discharge amount (recording rate) of each color ink used to reproduce each density gradation from white to black via blue on a blue line in the present exemplary embodiment.

First, in a low-density region close to white, in order to prevent a decrease in graininess which results from application of the cyan and magenta inks in a superimposing manner, the discharge amount of the light blue ink is increased to increase the density. Then, in an intermediate density region close to blue, it is no longer possible to reproduce a density with the light blue ink, so the discharge amounts of the cyan and magenta inks are increased while the discharge amount of the light blue ink is decreased to increase the density. Then, in a high-density region close to black, the discharge amount of the black ink is increased while the discharge amounts of the cyan and magenta inks are decreased to reproduce a density close to black.

Figure 4B:
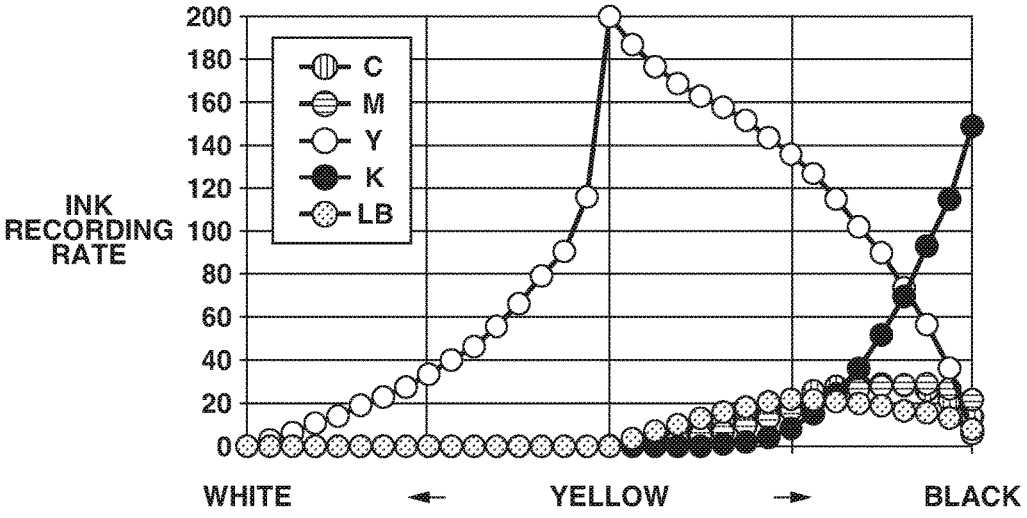

Further, FIG. 4B illustrates the discharge amount (recording rate) of each color ink used to reproduce each density gradation from white to black via yellow on a yellow line in the present exemplary embodiment.

In low to intermediate density regions from white to yellow, the discharge amount of the yellow ink is increased to increase the density. Further, in a region from the intermediate density region toward black, since simultaneous use of yellow, which has a high lightness, and black, which has a low lightness, can lead to image quality deteriorations, the cyan, magenta, and light blue inks are used while the discharge amount of the yellow ink is decreased to increase the density. Then, lastly, the discharge amount of the black ink is increased to reproduce a density close to black.

(Recording Head)

Figure 5:
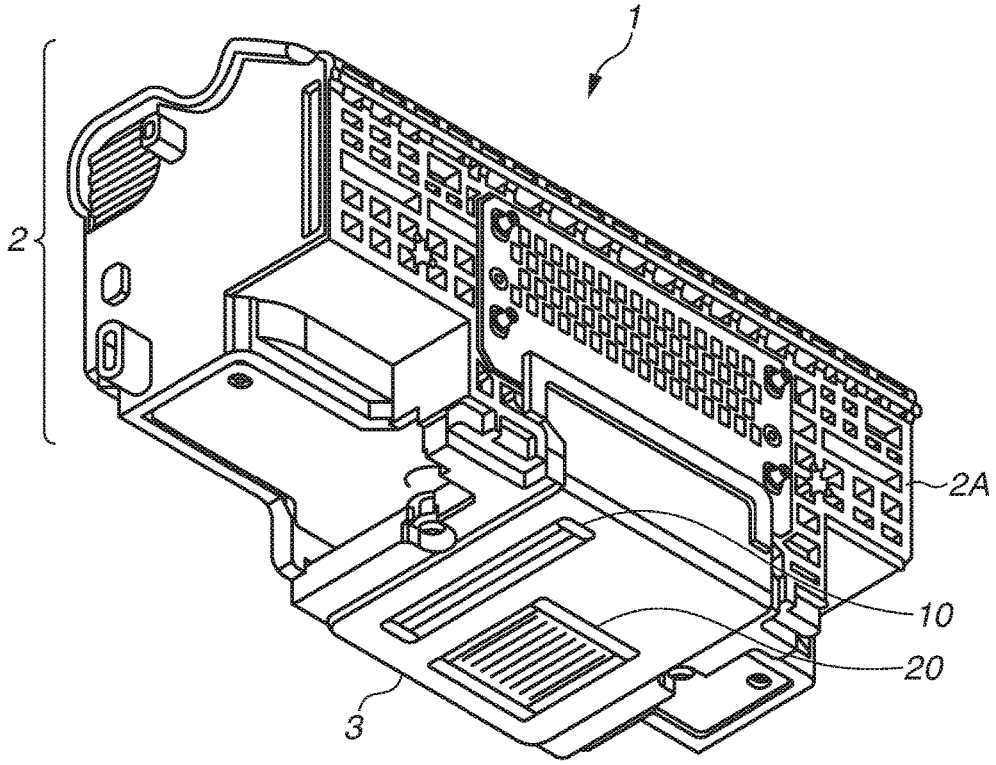
FIG. 5 is a perspective view illustrating a recording head according to the first exemplary embodiment.

FIG. 5 is a perspective view illustrating the recording head 1 used in the present exemplary embodiment.

The recording head 1 according to the present exemplary embodiment includes an ink supply unit 2 and an ink discharging unit 3 which are integrated. The ink supply unit 2 includes a holding member 2A which holds an ink tank (not illustrated) for supplying ink.

The ink discharging unit includes a chip (Bk chip) 10 for discharging a pigment black ink and a chip (Cl chip) 20 for discharging a dye ink described below. The following description focuses on the Cl chip 20.

Figure 6:
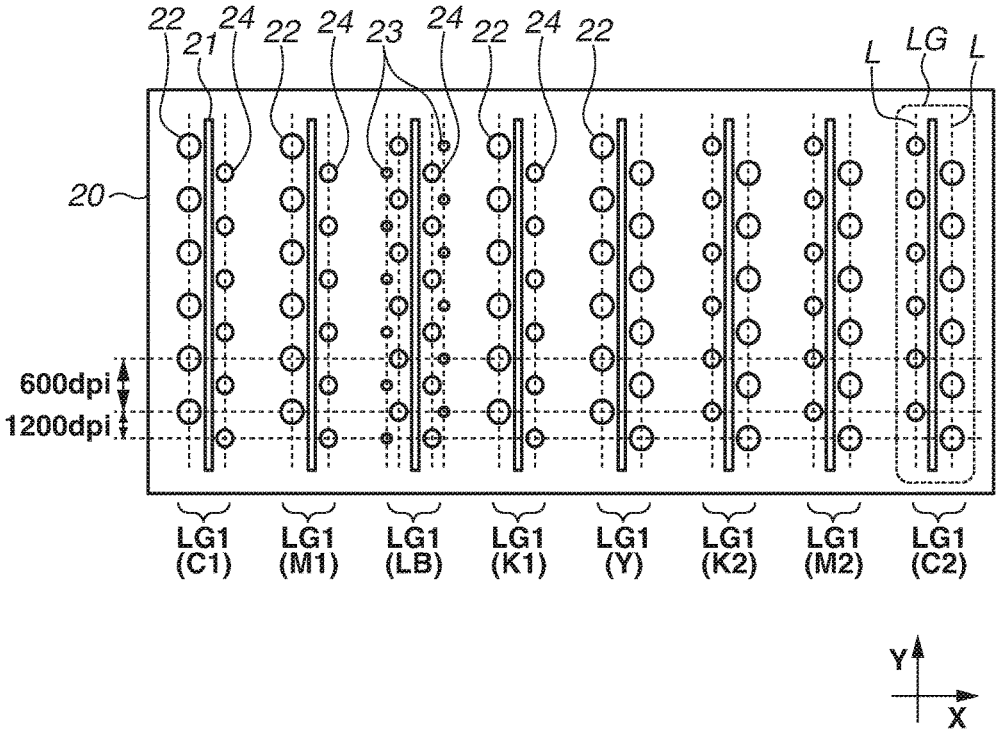
FIG. 6 illustrates a surface of a chip in a recording head according to the first exemplary embodiment.
Figure 7A:
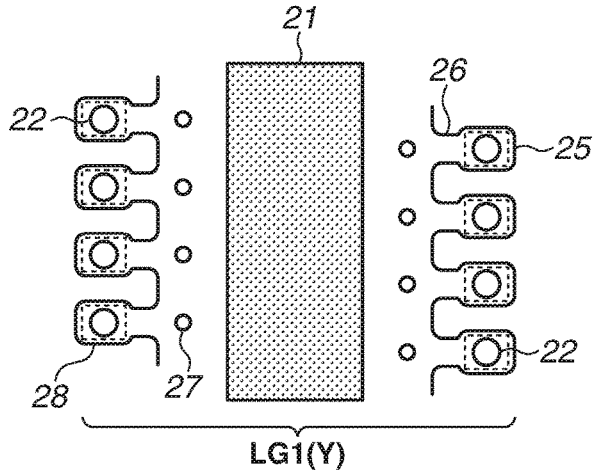
FIGS. 7A, 7B, and 7C are see-through views each illustrating a region around discharge openings in a recording head according to the first exemplary embodiment.
Figure 7B:
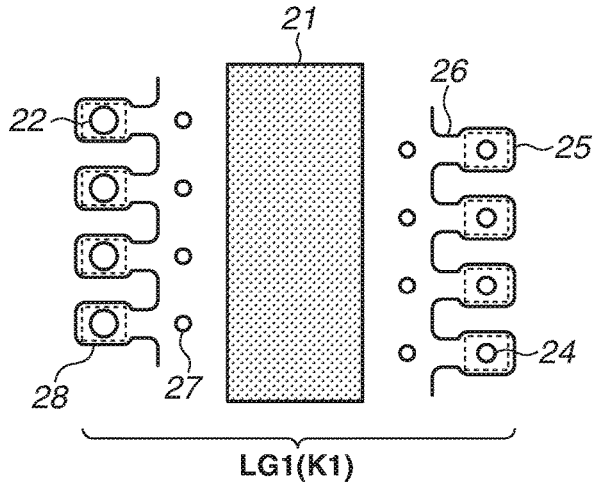
Figure 7C:
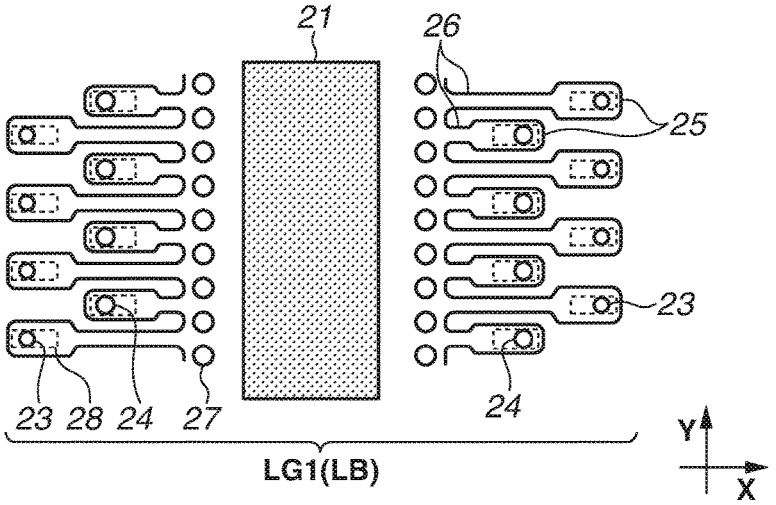

FIG. 6 is an enlarged view illustrating the Cl chip 20 in the recording head 1 according to the present exemplary embodiment. Further, FIGS. 7A, 7B, and 7C illustrate the internal configurations of discharge opening array units according to the present exemplary embodiment.

The Cl chip 20 according to the present exemplary embodiment includes eight common liquid chambers 21 in total connected to the ink supply unit 2. In each one of the common liquid chambers 21 is formed one discharge opening array unit LG1. Each the discharge opening array units LG1 includes a plurality of discharge opening arrays, and the diameters (discharge opening diameters) of discharge openings arranged in the respective discharge opening arrays differ among the discharge opening array units LG1.

Each of the discharge openings in the Cl chip 20 is opened with respect to a nozzle plate connected to a member (hereinafter, also referred to as "common liquid chamber forming member") forming the common liquid chambers 21. The common liquid chamber forming member includes thermoelectric conversion elements (hereinafter, also referred to as "heaters") situated to face the respective discharge openings.

The discharge opening array units LG1 in the Cl chip 20 will be described in detail below.

1. Yellow Ink Discharge Opening Array Unit

The Cl chip 20 according to the present exemplary embodiment includes only one yellow ink discharge opening array unit (LG1 (Y)). The yellow ink discharge opening array unit LG1 (Y) includes two discharge opening arrays.

FIG. 7A illustrates the yellow ink discharge opening array unit LG1 (Y) in detail.

In the yellow ink discharge opening array unit LG1 (Y), the two discharge opening arrays are provided on the respective sides of the common liquid chamber 21. The discharge opening arrays include relatively large discharge openings 22 each of which has a diameter of approximately 16 μm and through which an ink droplet of approximately 5 pl is discharged. In each of the discharge opening arrays, 264 discharge openings 22 are arranged at 600-dpi intervals (approximately 42.3 μm) in a Y-direction. Further, the discharge opening arrays are staggered at 1200-dpi intervals (approximately 21.2 μm) in the Y-direction.

Further, as described above, heaters 28 are provided in positions facing the discharge openings 22. Further, bubble generation chambers 25 are provided to respectively surround the heaters 28, and ink flow paths 26 are formed to connect the bubble generation chambers 25 to the common liquid chamber 21. Further, foreign substance blocking columns 27 are provided to block foreign substances contained in the ink from entering the ink flow paths 26. The configurations of the heaters 28, the bubble generation chambers 25, the ink flow paths 26, and the foreign substance blocking columns 27 are similar to those in other discharge opening array units LG1, so description thereof will be omitted hereinafter.

2. Black Ink Discharge Opening Array Unit, Cyan Ink Discharge Opening Array Unit, and Magenta Ink Discharge Opening Array Unit The Cl chip 20 according to the present exemplary embodiment includes two black ink discharge opening array units (LG1 (K1), LG1 (K2)). Each of the black ink discharge opening array units LG1 (K1) and LG1 (K2) includes two discharge opening arrays.

FIG. 7B illustrates the black ink discharge opening array unit LG1 (K1) in detail.

In the black ink discharge opening array unit LG1 (K1), one of the discharge opening arrays is provided on one side (left side) of the common liquid chamber 21. The discharge opening array includes relatively large discharge openings 22 each of which has a diameter of approximately 16 μm and through which an ink droplet of approximately 5 pl is discharged. Further, the other one of the discharge opening arrays is provided on the other side (right side) of the common liquid chamber 21. The discharge opening array includes moderate discharge openings 24 each of which has a diameter of approximately 12 μm and through which an ink droplet of approximately 2 pl is discharged. In the respective discharge opening arrays, 264 discharge openings 22 and 264 discharge openings 24 are respectively arranged at 600-dpi intervals (approximately 42.3 μm) in the Y-direction. Further, the discharge opening arrays are staggered at 1200-dpi intervals (approximately 21.2 μm) in the Y-direction.

As in the case of the discharge opening array unit LG1 (K1), the black ink discharge opening array unit LG1 (K2) includes discharge opening array including discharge openings each having a diameter of approximately 16 μm and a discharge opening array including discharge openings each having a diameter of approximately 12 μm. The two discharge opening array units LG1 (K1) and LG1 (K2) are different in that the locations of the two discharge opening arrays in the X-direction in the discharge opening array units LG1 (K1) and LG1 (K2) are opposite. Further, the two discharge opening arrays having the discharge openings of the same diameter in the discharge opening array units LG1 (K1) and LG1 (K2) are staggered at 1200-dpi intervals (approximately 21.2 μm) in the Y-direction.

A cyan ink discharge opening array unit LG1 (C1) and a magenta ink discharge opening array unit LG1 (M1) each have a similar configuration to the configuration of the black ink discharge opening array unit LG1 (K1). Further, a cyan ink discharge opening array unit LG1 (C2) and a magenta ink discharge opening array unit LG1 (M2) each have a similar configuration to the configuration of the black ink discharge opening array unit LG1 (K2).

3. Light Blue Ink Discharge Opening Array Unit

The Cl chip 20 according to the present exemplary embodiment includes one light blue ink discharge opening array unit (LG1 (LB)). The light blue ink discharge opening array unit LG1 (LB) includes four discharge opening arrays.

FIG. 7C illustrates the light blue ink discharge opening array unit LG1 (LB) in detail.

As illustrated in FIG. 7C, in the light blue ink discharge opening array unit LG1 (LB), two of the discharge opening arrays are provided on one side (left side) of the common liquid chamber 21. One of the two discharge opening arrays includes moderate discharge openings 24 each of which has diameter of approximately 12 μm and through which an ink drop of approximately 2 pl is discharged, and is situated close to the common liquid chamber 21. The other one of the two discharge opening arrays includes relatively small discharge openings 23 each of which has a diameter of approximately 9 μm and through which an ink droplet of approximately 1 pl is discharged, and is situated far from the common liquid chamber 21. Similarly, the other two of the discharge opening arrays are provided on the other side (right side) of the common liquid chamber 21, and the discharge opening diameters of the two discharge opening arrays are approximately 12 μm and approximately 9 μm, respectively. As described above, the light blue ink discharge opening array unit LG1 (LB) includes four discharge opening arrays in total, including two discharge opening arrays with a discharge opening diameter of approximately 12 μm and two discharge opening arrays with a discharge opening diameter of approximately 9 μm.

Each of the discharge opening arrays includes 264 discharge openings 23 or 24 arranged at 600-dpi intervals (approximately 42.3 μm) in Y-direction. Further, the two discharge opening arrays situated on the same site with respect to the common liquid chamber 21 (the discharge opening array with a discharge opening diameter of approximately 16 μm and the discharge opening array with a discharge opening diameter of approximately 12 μm) are staggered at 1200-dpi intervals (approximately 10.6 μm) in the Y-direction.

4. Arrangement Order of Discharge Opening Array in Chip

As illustrated in FIG. 6, in the chip 20 according to the present exemplary embodiment, the cyan ink discharge opening array unit LG1 (C1), the magenta ink discharge opening array unit LG1 (M1), the light blue ink discharge opening array unit LG1 (LB), the black ink discharge opening array unit LG1 (K1), the yellow ink discharge opening array unit LG1 (Y), the black ink discharge opening array unit LG1 (K2), the magenta ink discharge opening array unit LG1 (M2), and the cyan ink discharge opening array unit LG1 (C2) are arranged this order from the left.

The following describes the reason why the discharge opening array units are arranged in the above-described order.

In the present exemplary embodiment, the arrangement order of the discharge opening array units is determined based on two points. One of the points is to reduce a color difference between forward and backward scans. The other one of the points is to reduce image quality deteriorations resulting from deviations of ink landing positions. First, the color difference between forward and backward scans and the image quality deteriorations resulting from deviations of ink landing positions will be described below.

(1) Difference in Color Between Forward and Backward Scans

Figure 8A:
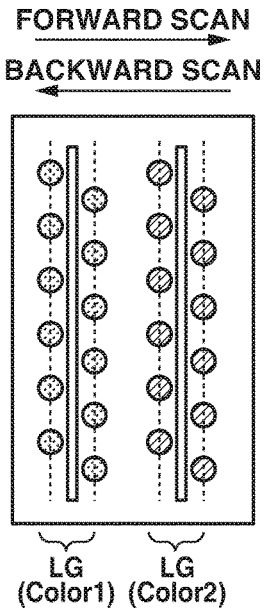
FIGS. 8A and 8B illustrate a color difference between forward and backward scans.

FIG. 8A illustrates a recording head including two discharge opening array units which are a discharge opening array unit LG (Color 1) for Color 1 and a discharge opening array unit LG (Color 2) for Color 2, which is different from Color 1. Further, FIG. 8B illustrates the appearances of landed ink droplets in the recording performed by forward and backward scans using the recording head illustrated in FIG. 8A.

In the case where the recording head illustrated in FIG. 8A is used, inks of Colors 2 and 1 are discharged in this order in forward scans, and inks of Colors 1 and 2 are discharged in this order in backward scans, with respect to the same position on a recording medium in a scan direction.

Figure 8B:
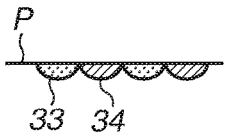
Figure 8B:
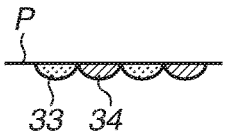
Figure 8B:
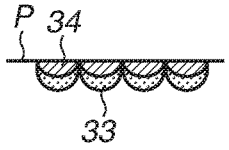
Figure 8B:
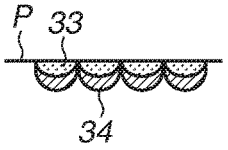

If the inks of Colors 1 and 2 are discharged in small amounts and thus are not discharged onto the same region on a recording medium P, dots 33 of Color 1 and dots 34 of Color 2 are not superimposed, as illustrated in FIG. 8B. Thus, although the inks are applied in different order in forward and backward scans, landed dots exhibit the same appearance, so reproduced colors are substantially the same.

However, if the inks of Colors 1 and 2 are discharged in large amounts and thus are discharged onto the same region, different colors are reproduced in forward and backward scans. As illustrated in FIG. 8B, in the forward scan, the ink of Color 2 is applied onto a recording medium P to form dots 34, and then the ink of Color 1 is applied onto the dots 34. Since a dye ink moves around previously-formed dots and is fixed, dots 33 of Color 1 are formed below the dots 34 of Color 2. Therefore, in the forward scan, an image with Color 2, which is the color of the dots 34 formed at a higher layer on the recording medium P, being a dominant color is recorded. On the other hand, in the backward scan, the inks of Colors 1 and 2 are applied in this order, so dots 33 of Color 1 are formed at a higher layer. Therefore, Color 1 becomes a dominant color.

As described above, in the case where the inks are discharged in large amounts, Color 2 becomes the dominant color in forward scans, and Color 1 becomes the dominant color in backward scans. This difference in dominant color results in a color difference between the forward and backward scans.

(2) Image Quality Deterioration Resulting from Deviation of Ink Landing Position When the recording head is attached at a tilt to the recording apparatus or when scans performed by the recording head are tilted, the longer the distance between the discharge opening array units is, the more deviated the landing positions of inks discharged from the discharge opening array units are.

Figure 9A:
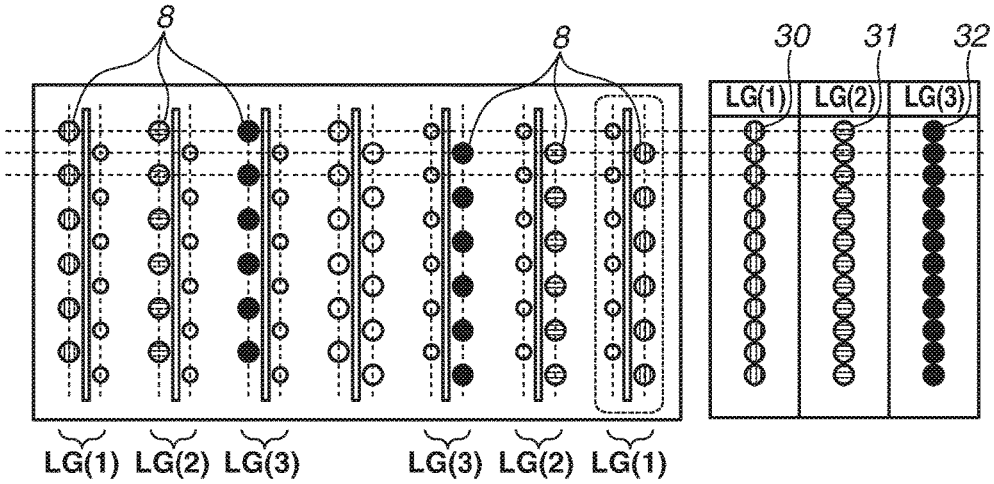
FIGS. 9A and 9B illustrate image quality deteriorations resulting from a deviation of ink landing positions.

FIG. 9A schematically illustrates the landing positions of inks discharged from two discharge opening array units LG (1), two discharge opening array units LG (2), and two discharge opening array units LG (3), which respectively discharge inks of different colors, of a recording head in a case where the above-described tilt does not occur. Further, FIG. 9B schematically illustrates the landing positions of inks discharged from the discharge opening array units LG (1), LG (2), and LG (3) in a case where the above-described tilt occurs in the recording head illustrated in FIG. 9A.

Figure 9B:
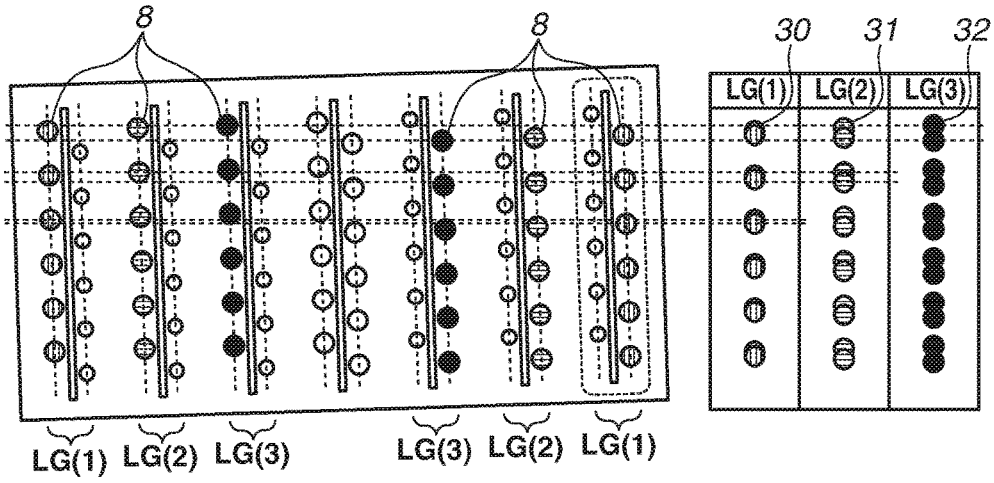

FIGS. 9A and 9B illustrate the recording head including the discharge opening array units LG (1), LG (2), and LG (3) arranged in the X-direction such that the two discharge opening array units LG (2) are located between the two discharge opening array units LG (1) and the two discharge opening array units LG (3) are located between the two discharge opening array units LG (2). In other words, the distance between the discharge opening array units LG (1) is the longest, and the distance between the discharge opening array units LG (3) is the shortest.

Further, in FIGS. 9A and 9B, positions 30 indicate the landing positions of the ink from the discharge opening array units LG (1), positions 31 indicate the landing positions of the ink from the discharge opening array units LG (2), and positions 32 indicate the landing positions of the ink from the discharge opening array units LG (3). In the present exemplary embodiment, the landing positions of inks discharged from the discharge opening arrays that include discharge openings specified by ruled lines or in black among a plurality of discharge openings arranged in the Y-direction in the discharge opening array units LG (1), LG (2), and LG (3) will be described below.

As illustrated in FIG. 9A, in the case where no tilt occurs, ink droplets from the two discharge opening array units LG (1), the two discharge opening array units LG (2), and the two discharge opening array units LG (3) land at the same intervals as the intervals at which the discharge openings are located. Thus, the landing positions of the inks remain the same regardless of the distance between the discharge opening array units.

On the other hand, in the case where the tilt occurs, an extent of a deviation of ink landing positions in the Y-direction varies depending on the distance between the discharge opening array units, as illustrated in FIG. 9B. For example, the case of the discharge opening array units LG (3) located at a relatively short distance from each other, when the tilt occurs, the landing positions of the inks deviate as specified by the positions 32 in FIG. 9B, but the deviations are not so significant, compared with the positions 32 in FIG. 9A. However, in the case of the discharge opening array units LG (1) located at a relatively long distance from each other, when the tilt occurs, the landing positions of the inks deviate significantly as specified by the positions 30 in FIG. 9B, compared with the positions 30 in FIG. 9A.

As described above, the longer the distance between the discharge opening array units is, the more the ink landing positions deviate when the tilt occurs, and this causes a significant impact on image quality deteriorations.

The arrangement order of the discharge opening array units according to the present exemplary embodiment is determined in view of (1) the color difference between forward and backward scans and (2) the image quality deteriorations resulting from deviations of ink landing positions.

First, in order to reduce (1) the color difference between forward and backward scans described above, the cyan ink discharge opening array units LG1 (C1) and LG1 (C2), the magenta ink discharge opening array units LG1 (M1) and LG1 (M2), the yellow ink discharge opening array unit LG1 (Y), and the black ink discharge opening array units LG1 (K1) and LG1 (K2) in the chip 20 in FIG. 6 are symmetrically arranged.

Specifically, the two magenta ink discharge opening array units LG1 (M1) and LG1 (M2) are situated between the two cyan ink discharge opening array units LG1 (C1) and LG1 (C2). Further, the two black ink discharge opening array units LG1 (K1) and LG1 (K2) are situated between the two magenta ink discharge opening array units LG1 (M1) and LG1 (M2). Further, the one yellow ink discharge opening array unit LG1 (Y) is situated between the two black ink discharge opening array units LG1 (K1) and LG1 (K2).

Thus, the cyan, magenta, yellow, and black inks are applied in the same order in both forward and backward scans. Specifically, the cyan, magenta, black, yellow, black, magenta, and cyan inks are applied in this order in both forward and backward scans. Thus, as to the cyan, magenta, yellow, and black inks, difference between the forward and backward scans can be reduced.

Meanwhile, as illustrated in FIG. 6, the light blue ink discharge opening array unit LG1 (LB) is symmetrically arranged with respect to the cyan ink discharge opening array units LG1 (C1) and LG1 (C2) and the magenta ink discharge opening array units LG1 (M1) and LG1 (M2) but asymmetrically arranged with respect to the black ink discharge opening array units LG1 (K1) and LG1 (K2).

Specifically, the light blue ink discharge opening array unit LG1 (LB) is situated between the two cyan ink discharge opening array units LG1 (C1) and LG1 (C2) and between the two magenta ink discharge opening array units LG1 (M1) and LG1 (M2). Thus, for example, as to the light blue ink and the cyan ink, the cyan, light blue, and cyan inks are discharged in this order in both forward and backward scans. Thus, as to the light blue ink and the cyan ink or as to the light blue ink and the magenta ink, a color difference between the forward and backward scans can be reduced.

On the other hand, the light blue ink discharge opening array unit LG1 (LB) is situated not between the two black ink discharge opening array units LG1 (K1) and LG1 (K2). In other words, as to the light blue ink and the black ink, the light blue ink discharge opening array unit LG1 (LB), the black ink discharge opening array unit LG1 (K1), and black ink discharge opening array unit LG1 (K2) are arranged in this order from the left. Thus, the black, black, and light blue inks are discharged in this order in forward scans, whereas the light blue, black, and black inks are discharged in this order in backward scans, with respect to the same position on a recording medium in the X-direction. Thus, when the light blue ink and the black inks are discharged in large amounts, a color difference between forward and backward scans can occur between the light blue ink and the black ink.

However, as described above with reference to FIGS. 4A and 4B, in the present exemplary embodiment, the recording rate (discharge amount) of each color ink is determined such that the light blue ink and the black ink are not substantially simultaneously discharged. In other words, substantially no color is reproduced using both the light blue ink and the black ink in the present exemplary embodiment.

For example, as illustrated in FIG. 4A, the light blue ink is used while substantially no black ink is used in the low- to intermediate-densities on the blue line. Further, the black ink is used while no light blue ink is used in the intermediate- to high-densities.

Further, as illustrated in FIG. 4B, the light blue ink and the black ink are both used in the high densities on the yellow line, but the discharge amounts are small.

As described above, according to the present exemplary embodiment, the light blue ink and the black ink are not discharged in large amounts to the same region. Thus, superimposition of dots of the light blue ink and the black ink which is described above with reference to FIG. 8B is less likely to occur. Accordingly, although the light blue ink discharge opening array unit LG1 (LB) is asymmetrically situated with respect to the black ink discharge opening array units LG1 (K1) and LG1 (K2), a color difference between forward and backward scans is less likely to occur with respect to the light blue ink and the black ink.

Meanwhile, as illustrated in FIG. 4A, the light blue ink and the cyan ink can be used simultaneously in relatively large amounts in the intermediate densities, etc. on the blue line. In other words, in the present exemplary embodiment, there are many colors that are reproduced using both the light blue ink and the cyan ink.

Thus, to the light blue ink and the cyan ink, color difference between forward and backward scans can occur, so that the light blue ink discharge opening array unit LG1 (LB) is symmetrically arranged with respect to the cyan ink discharge opening array units LG1 (C1) and LG1 (C2). The same applies to the light blue ink and the magenta ink.

In view of the reduction of (1) the color difference between forward and backward scans alone, the light blue ink discharge opening array unit LG1 (LB) does not have to be arranged asymmetrically with respect to the two black ink discharge opening array units LG1 (K1) and LG1 (K2) as illustrated in FIG. 6. In other words, even if the light blue ink discharge opening array unit LG1 (LB) is arranged in a symmetric position, i.e., between the two black ink discharge opening array units LG1 (K1) and LG1 (K2), no color difference between forward and backward scans is likely to occur with respect to the light blue ink and the black ink as in the present exemplary embodiment.

However, if the light blue ink discharge opening array unit LG1 (LB) is arranged between the two black ink discharge opening array units LG1 (K1) and LG1 (K2), the distance between the two black ink discharge opening array units LG1 (K1) and LG1 (K2) is increased by the light blue ink discharge opening array LG1 (LB). Thus, as described above in the section "(2) Image Quality Deterioration Resulting from Deviation of Ink Landing position", a significant deviation of landing positions of the black ink can occur. As shown in (Table 1), the black ink has the lowest lightness and is easy to visually recognize, so that deterioration in image quality which results from occurrence of landing position deviation can be significant.

In view of the foregoing point, according to the present exemplary embodiment, the light blue ink discharge opening array unit LG1 (LB) is arranged not between the two black ink discharge opening array units LG1 (K1) and LG1 (K2). In this way, the distance between the black ink discharge opening array units LG1 (K1) and LG1 (K2) is reduced. This arrangement can reduce to some extent a deviation of landing positions of the black ink, which is easy to visually recognize, to reduce image quality deteriorations. As described above, the light blue ink and the black ink are less likely to be used simultaneously, so the arrangement as described above does not lead to a color difference between forward and backward scans with respect to the light blue ink and the black ink.

The arrangement enables recording with reduced image quality deteriorations resulting from deviations of ink landing positions while a color difference between forward and backward scans is reduced.

While the arrangement in which the two magenta ink discharge opening array units LG1 (M1) and LG1 (M2) are arranged between the two cyan ink discharge opening array units LG1 (C1) and LG1 (C2) is described in the first exemplary embodiment, other arrangements can also be implemented. A similar advantage to that produced by the present exemplary embodiment can be produced if the two black ink discharge opening array units LG1 (K1) and LG1 (K2) are arranged between the two cyan ink discharge opening array units LG1 (C1) and LG1 (C2) and between t two magenta ink discharge opening array units LG1 (M1) and LG1 (M2) and the light blue ink discharge opening array unit LG1 (LB) is arranged between the two cyan ink discharge opening array units LG1 (C1) and LG1 (C2), between the two magenta ink discharge opening array units LG1 (M1) and LG1 (M2), and not between the two black ink discharge opening array units LG1 (K1) and LG1 (K2). For example, the cyan ink discharge opening array unit LG1 (C1), the magenta ink discharge opening array unit LG1 (M1), the light blue ink discharge opening array unit LG1 (LB), the black ink discharge opening array unit LG1 (K1), the yellow ink discharge opening array unit LG1 (Y), the black ink discharge opening array unit LG1 (K2), the magenta ink discharge opening array unit LG1 (M2), and the cyan ink discharge opening array unit LG1 (C2) can be arranged in this order from the left. Even in this case, color difference between forward and backward scans is reduced with respect to the light blue ink and the cyan ink, which can be discharged simultaneously in large amounts, and with respect to the light blue ink and the magenta ink, which can be discharged simultaneously in large amounts, and the distance between the two black ink discharge opening array units LG1 (K1) and LG1 (K2) is shortened to reduce deviations of ink landing positions. It is more desirable, however, to arrange the two magenta ink discharge opening array units LG1 (M1) and LG1 (M2) between the two cyan ink discharge opening array units LG1 (C1) and LG1 (C2) or to arrange the two cyan ink discharge opening array units LG1 (C1) and LG1 (C2) between the two magenta ink discharge opening array units LG1 (M1) and LG1 (M2), because color difference between forward and backward scans with respect to the cyan ink and the magenta ink can be further reduced.

In the first exemplary embodiment described above, the arrangement is described in which the cyan ink discharge opening array unit and the magenta ink discharge opening array unit each include the discharge opening arrays which respectively have a large discharge opening diameter and a moderate discharge opening diameter.

In a second exemplary embodiment, an arrangement will be described in which the cyan ink discharge opening array unit and the magenta ink discharge opening array unit each include three discharge opening arrays in total including a discharge opening array having a small discharge opening diameter in addition to the discharge opening array having a large discharge opening diameter and the discharge opening array having a moderate discharge opening diameter.

Description of similar points to those in the first exemplary embodiment is omitted.

Figure 10:
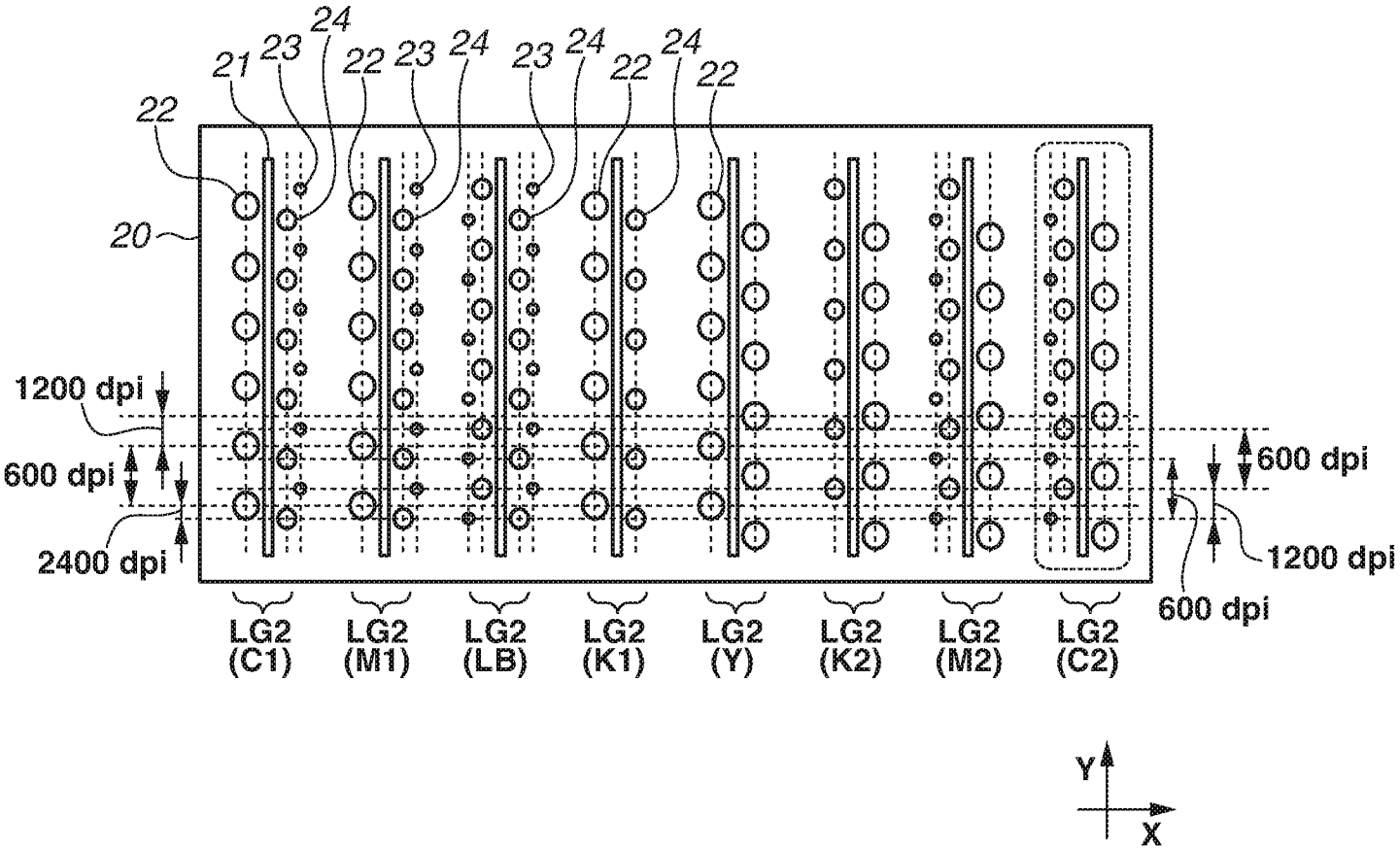
FIG. 10 illustrates a surface of a chip in a recording head according to a second exemplary embodiment.

FIG. 10 is an enlarged view illustrating the Cl chip 20 in the recording head according to the present exemplary embodiment. Further, FIGS. 9A and 9B illustrate the internal configuration of the cyan ink discharge opening array unit according to the present exemplary embodiment.

From a comparison between the Cl chip in FIG. 10 which is used in the present exemplary embodiment and the Cl chip in FIG. 6 which is used in the first exemplary embodiment, it is understood that the Cl chip in the present exemplary embodiment is similar to the Cl chip in the first exemplary embodiment in the arrangement order of discharge opening array units and the configurations of a light blue ink discharge opening array unit LG2 (LB), black ink discharge opening array units LG2 (K1) and LG2 (K2), and a yellow ink discharge opening array unit LG2 (Y).

The Cl chip used in the present exemplary embodiment is different from the Cl chip used in the first exemplary embodiment in that cyan ink discharge opening array units LG2 (C1) and LG2 (C2) and magenta ink discharge opening array units LG2 (M1) and LG2 (M2) each include a discharge opening array including discharge openings 23 having a relatively small discharge opening diameter in addition to the discharge opening array including the discharge openings 22 having a large discharge opening diameter and the discharge opening array including the discharge openings 24 having a moderate discharge opening diameter.

Details will be described below.

1. Cyan Ink Discharge Opening Array Unit and Magenta Ink Discharge Opening Array Unit The Cl chip 20 according to the present exemplary embodiment includes two cyan ink discharge opening array units (LG2 (C1), LG2 (C2)). The cyan ink discharge opening array units LG2 (C1) and LG2 (C2) each include three discharge opening arrays.

Figure 11:
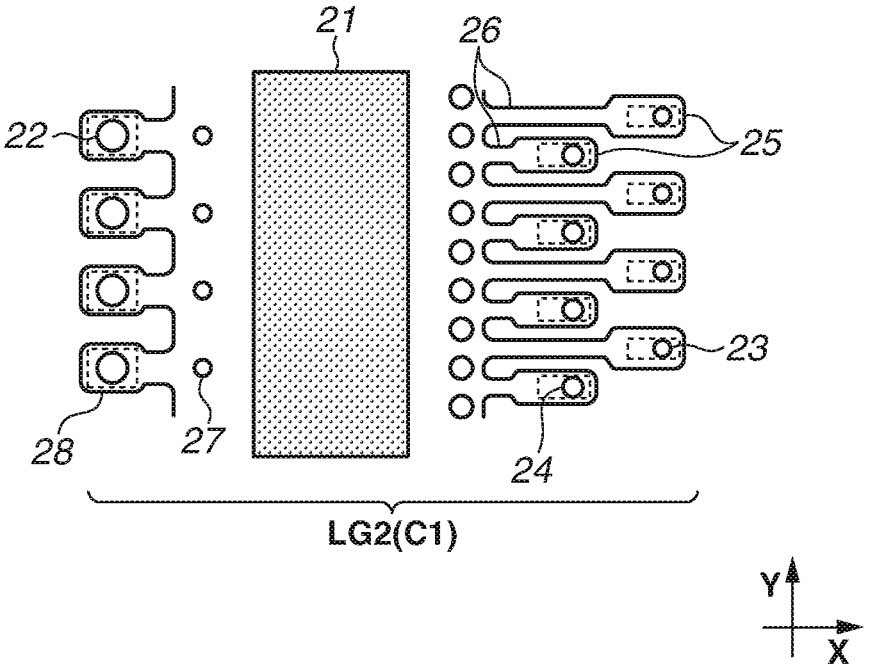
FIG. 11 is a see-through view illustrating a region around discharge openings in a recording head according to the second exemplary embodiment.

As illustrated in FIG. 11, in the cyan ink discharge opening array unit LG2 (C1), one of the discharge opening arrays is provided on one side (left side) of the common liquid chamber 21. This discharge opening array includes the relatively large discharge openings 22 each of which has a diameter of approximately 16 μm and through which an ink droplet of approximately 5 pl is discharged. Further, the other two discharge opening arrays are provided on the other side (right side) of the common liquid chamber 21. One of the two discharge opening arrays includes the moderate discharge openings 24 each of which has a diameter of approximately 12 μm and through which an droplet of approximately 2 pl is discharged, and is situated close to the common liquid chamber 21. The other one of the two discharge opening arrays includes the relatively small discharge openings 23 each of which has a diameter of approximately 9 μm and through which an ink droplet of approximately 1 pl is discharged, and is situated far from the common liquid chamber 21.

Each of the discharge opening arrays includes 264 discharge openings 22, 23, or 24 arranged at 600-dpi intervals (approximately 42.3 μm) in the Y-direction. Further, the discharge opening array including the discharge openings 22 having a discharge opening diameter of approximately 16 μm and the discharge opening array including the discharge openings 24 having a discharge opening diameter of approximately 12 μm are staggered at 2400-dpi intervals (approximately 10.6 μm) in the Y-direction. Further, the discharge opening array including the discharge openings 24 having a discharge opening diameter of approximately 12 μm and the discharge opening array including the discharge openings 23 having a discharge opening diameter of approximately 9 μm are staggered at 1200-dpi intervals (approximately 21.2 μm) in the Y-direction.

As described above, cyan ink droplets are discharged in three sizes including 5 pl, 2 pl, and 1 pl so that graininess can be made less visible in a wide range of density gradations. In the first exemplary embodiment, inks of only two sizes, 5 pl and 2 pl, can be discharged. Thus, even in the reproduction of a low density, 2-pl cyan ink droplets have to be used, so that formed dots are not so small, and thus graininess may be visible. However, in the present exemplary embodiment, 1-pl cyan ink droplets can be used to reproduce a low density, so that the dot size can be decreased and graininess can be made less visible.

The cyan ink discharge opening array unit LG2 (C2) is similar to the discharge opening array unit LG2 (C1) in that the cyan ink discharge opening array unit LG2 (C2) includes a discharge opening array having a discharge opening diameter of approximately 16 μm, a discharge opening array having a discharge opening diameter of approximately 12 μm, and a discharge opening array having a discharge opening diameter of approximately 9 μm. The cyan ink discharge opening array unit LG2 (C2) is different from the discharge opening array unit LG2 (C1) in that the arrangement of the three discharge opening arrays in the X-direction in the discharge opening array unit LG2 (C2) is opposite to the arrangement in the discharge opening array units LG2 (C1). Further, the two discharge opening arrays including the discharge openings of the same diameter in the discharge opening array units LG2 (C1) and LG2 (C2) are staggered at 1200-dpi intervals (approximately 21.2 μm) in the Y-direction.

Further, the magenta ink discharge opening array unit LG2 (M1) has a similar configuration to the configuration of the cyan ink discharge opening array unit LG2 (C1), and the magenta ink discharge opening array unit LG2 (M2) has a similar configuration to the configuration of the cyan ink discharge opening array unit LG2 (C2).

2. Arrangement Order of Discharge Opening Array Units in Chip

As illustrated in FIG. 10, in the chip 20 according to the present exemplary embodiment, the cyan ink discharge opening array unit LG2 (C1), the magenta ink discharge opening array unit LG2 (M1), the light blue ink discharge opening array unit LG2 (LB), the black ink discharge opening array unit LG2 (K1), the yellow ink discharge opening array unit LG2 (Y), the black ink discharge opening array unit LG2 (K2), magenta ink discharge opening array unit LG2 (M2), and the cyan ink discharge opening array unit LG2 (C2) are arranged in this order from the left.

Specifically, in the present exemplary embodiment, the two black ink discharge opening array units LG2 (K1) and LG2 (K2) are arranged between the two cyan ink discharge opening array units LG2 (C1) and LG2 (C2) and between the two magenta ink discharge opening array units LG2 (M1) and LG2 (M2), as in the first exemplary embodiment. Further, the light blue ink discharge opening array unit LG2 (LB) is arranged between the two cyan ink discharge opening array units LG2 (C1) and LG2 (C2), between the two magenta ink discharge opening array units LG2 (M1) and LG2 (M2), and not between the two black ink discharge opening array units LG2 (K1) and LG2 (K2).

Thus, in the present exemplary embodiment, a color difference between forward and backward scans is reduced with respect to the light blue ink and the cyan ink, which can be discharged simultaneously in large amounts, and with respect to the light blue ink and the magenta ink, which can be discharged simultaneously in large amounts. Further, the distance between the two black ink discharge opening array units LG2 (K1) and LG2 (K2) is shortened to reduce image quality deteriorations resulting from a deviation of landing positions of low-lightness inks.

In the above-described exemplary embodiments, an ink that satisfies the conditions that the light blue ink has a hue angle h3 between hue angles h1 and h2 of the cyan ink and the magenta ink and has a higher lightness L3 than each of lightnesses L1 and L2 of the cyan ink and the magenta ink is used as the light blue ink. However, as a result of studies conducted by the present inventors, it was found that it was desirable to satisfy $$h1+(h'-h1)/2<h3<h2-(h2-h')/2, \quad \text{(formula 1)}$$

$$L'-L3>L3-L1, \text{ and} \quad \text{(formula 2)}$$

$$L'-L3>L3-L2, \quad \text{(formula 3)}$$

where h' is the hue angle of blue in a case where the cyan ink and the magenta ink of equal amounts are mixed, and L' is the surface lightness of a recording medium used.

In order to suitably reproduce the blue hue with the light blue ink, the hue of the light blue ink is desirably close to the hue of the blue ink as much a possible rather than to the hues of the cyan ink and the magenta ink.

In (formula 1), h'−h1 corresponds to a difference between the hue angles of blue and cyan. Accordingly, the term h1+(h'−h1)/2 in (formula 1) corresponds to a hue shifted from the cyan hue toward the blue hue by a half of the difference between the hue angles of blue and cyan. In other words, the term h1+(h'−h1)/2 in (formula 1) corresponds to the middle hue between the cyan hue and the blue hue.

Further, h2−h' corresponds to a difference between the hue angles of magenta and blue. Accordingly, the term h2−(h2−h')/2 in (formula 1) corresponds to a hue shifted from the magenta hue toward the blue hue by a half of the difference between the hue angles of magenta and blue. In other words, the term h2−(h2−h')/2 in (formula 1) corresponds to the middle hue between the magenta hue and the blue hue.

Accordingly, when the hue angle h3 of the light blue ink satisfies (formula 1), this indicates that the hue of the light blue ink is located between the middle hue of the cyan hue and the blue hue and the middle hue of the magenta hue and the blue hue.

Further, in the exemplary embodiments, the blue hue is reproduced with the light blue ink in the low to intermediate densities or with the cyan ink and the magenta ink in the intermediate to high densities, as illustrated in FIG. 4A.

If the lightness of the light blue ink is excessively high, a gap arises between the lightness of the light blue ink and the lightnesses of the cyan ink and the magenta ink. This can make graininess of the cyan ink and the magenta ink visible when the cyan ink and the magenta ink are applied onto the light blue ink. Thus, the lightness of the light blue ink is desirably closer to the lightnesses of the cyan ink and the magenta ink than to the surface lightness of a recording medium.

In (formula 2), the term L'−L3 corresponds to a difference in lightness between a recording medium and the light blue ink, and the term L3−L1 corresponds to a difference in lightness between the light blue ink and the cyan ink. Accordingly, when the lightness L3 of the light blue ink satisfies (formula 2), this indicates that the difference in lightness between the recording medium and the light blue ink is greater than the difference in lightness between the light blue ink and the cyan ink, i.e., the lightness of the light blue ink is closer to the lightness of the cyan ink than to the surface lightness of the recording medium.

Further, the term L3−L2 in (formula 3) corresponds to a difference in lightness between the light blue ink and the magenta ink. Thus, when the lightness L3 of the light blue ink satisfies (formula 3), this indicates that the difference in lightness between the recording medium and the light blue ink is greater than the difference in lightness between the light blue ink and the magenta ink, i.e., the lightness of the light blue ink is closer to the lightness of the magenta ink than to the surface lightness of the recording medium, because discharged ink droplets are less likely to be impacted by airflows.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

Further, while the exemplary embodiments are described above in which there are only a few colors to be reproduced using both the light blue ink and the black ink while there are many colors to be reproduced using both the light blue ink and the cyan ink or both the light blue ink and the magenta ink, other embodiments can be implemented. If the condition that the number of colors to be reproduced using both the light blue ink and the black ink is smaller than the number of colors to be reproduced using both the light blue ink and the cyan ink and is also smaller than the number of colors to be reproduced using both the light blue ink and the magenta ink is satisfied, an advantage can be produced by a similar arrangement to that according to the present exemplary embodiment. It the above-described condition is satisfied, a color difference between forward and backward scans is less likely to occur between the light blue ink and the black ink, compared to between the light blue ink and the cyan ink and between the light blue ink and the magenta ink.

Further, while the exemplary embodiments are described above in which each discharge opening array unit includes plurality of discharge opening arrays, each discharge opening array unit may consist of only one discharge opening array. For example, every discharge opening array unit may consist of only one discharge opening array including discharge openings through which 5-pl ink droplets are discharged.

It should be noted, however, that in a discharge opening array unit including two or more discharge opening arrays having a large discharge opening diameter, e.g., in she yellow ink discharge opening array unit LG1 (Y) illustrated in FIG. 6, strong airflows can be generated near the discharge opening array unit due to many large-sized ink droplets being discharged therefrom. If a discharge opening array unit including a discharge opening array having a small discharge opening diameter, e.g., the light blue ink discharge opening array unit LG1 (LB) illustrated in FIG. 6, is provided near such a discharge opening array unit, small-sized ink droplets of 1 pl are significantly impacted by the airflows, so that a deviation of ink landing positions can occur in the discharge opening array having a small discharge opening diameter and lead to image deteriorations.

On the other hand, in the arrangements of the discharge opening array units according to the first and second exemplary embodiments, the discharge opening array unit LG1 (Y) is not provided next to the discharge opening array unit LG1 (LB). Instead, the discharge opening array unit LG1 (K1) is provided between the discharge opening array unit LG1 (Y) and the discharge opening array unit LG1 (LB) as illustrated in FIG. 6 so that image quality deteriorations resulting from the airflows are reduced. Specifically, since the discharge opening array unit LG1 (K1) includes only one discharge opening array having a large discharge opening diameter, strong airflows are less likely to occur in the vicinity. Further, since the discharge opening array unit LG1 (K1) includes no discharge opening array having a small discharge opening diameter, ink droplets discharged from the discharge opening array unit LG1 (K1) are less likely to be impacted by the airflows even if strong airflows are generated as a result of discharging from the discharge opening array unit LG1 (Y).

The recording head according to an exemplary embodiment of the present invention is capable of reducing a color difference between forward and backward scans while reducing image quality deteriorations resulting from deviations of ink landing positions.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-161918, filed Aug. 22, 2016, which is here incorporated by reference herein in its entirety.

What is claimed is:

1. A recording head comprising:

a plurality of discharge opening array units arranged side by side and including at least two first discharge opening array units for discharging an ink of a first color;

two second discharge opening array units for discharging an ink of a second color;

a third discharge opening array unit for discharging an ink of a third color; and two fourth discharge opening array units for discharging an ink of a fourth color, wherein $$h1<h3<h2,$$

$$L3>L1>L4, \text{ and}$$

$$L3>L2>L4$$

are satisfied, where h1 is a hue angle of the first color, L1 is a lightness of the first color, h2 is a hue angle of the second color, L2 is a lightness of the second color, h3 is a hue angle of the third color, L3 is a lightness of the third color, and L4 is a lightness of the fourth color, wherein the third discharge opening array unit is the only discharge opening unit, among the plurality of discharge opening array units, for discharging the ink of the third color, and wherein the plurality of discharge opening array units is arranged in such a manner that the one third discharge opening array unit is located between the two first discharge opening array units, between the two second discharge opening array units, and not between the two fourth discharge opening array units.

2. The recording head according to claim 1, wherein $$h1+(h'-h1)/2<h3<h2-(h2-h')/2$$

is satisfied, where h' is a hue angle of a color reproduced by a mixture of equal amounts of the ink of the first color and the ink of the second color.

3. The recording head according to claim 1, wherein $$L'-L3>L3-L1, \text{ and}$$

$$L'-L3>L3-L2$$

are satisfied, where L' is a lightness of a color of a surface of a recording medium.

4. The recording head according to claim 1, wherein the first color is cyan, the second color is magenta, the third color is light blue, and the fourth color is black.

5. The recording head according to claim 1, wherein the number of colors to be reproduced using both the ink of the third color and the ink of the fourth color is smaller than the number of colors to be reproduced using both the ink of the first color and the ink of the third color and is smaller than the number of colors to be reproduced using both the ink of the second color and the ink of the third color.

6. The recording head according to claim 1, wherein the plurality of discharge opening array units is arranged in such a manner that the two fourth discharge opening array units are located between the two first discharge opening array units and between the two second discharge opening array units.

7. The recording head according to claim 1, wherein the plurality of discharge opening array units is arranged in such a manner that the two second discharge opening array units are located between the two first discharge opening array units.

8. The recording head according to claim 1, wherein the plurality of discharge opening array units further includes one fifth discharge opening array unit for discharging an ink of a fifth color, wherein $$h5<h1, \text{ and}$$

$$L5>L4$$

are satisfied, where h5 is a hue angle of the fifth color, and L5 is a lightness of the fifth color, and wherein the plurality of discharge opening array units is arranged in such a manner that the one fifth discharge opening array unit is located between the two fourth discharge opening array units.

9. The recording head according to claim 8, wherein the fifth color is yellow.

10. The recording head according to claim 8, wherein the plurality of discharge opening array units consists of only eight discharge opening array units which are the two first discharge opening array units, the two second discharge opening array units, the one third discharge opening array unit, the two fourth discharge opening array units, and the one fifth discharge opening array unit.

11. The recording head according to claim 8, wherein each of the plurality of discharge opening array units includes at least one of a first discharge opening array including a discharge opening having a first diameter and arranged in a predetermined direction, a second discharge opening array including a discharge opening having a second diameter smaller than the first diameter and arranged in the predetermined direction, and a third discharge opening array including a discharge opening having a third diameter smaller than the second diameter and arranged in the predetermined direction, wherein each of the two first discharge opening array units includes the third discharge opening array, wherein each of the two second discharge opening array units includes the third discharge opening array, wherein the one third discharge opening array unit includes at least the third discharge opening array and includes the first discharge opening array(s) of fewer than N, wherein each of the two fourth discharge opening array units includes the first discharge opening array(s) of fewer than N, includes the second discharge opening array, and does not include the third discharge opening array, and wherein the one fifth discharge opening array unit includes the first discharge opening array(s) of N ($N\geq 2$) and does not include the third discharge opening array.

12. The recording head according to claim 11, wherein each of the two first discharge opening array units consists of only three discharge opening arrays which are the one third discharge opening array, the one second discharge opening array, and the one first discharge opening array, wherein each of the two second discharge opening array units consists of only three discharge opening arrays which are the one third discharge opening array, the one second discharge opening array, and the one first discharge opening array, wherein the one third discharge opening array unit consists of only four discharge opening arrays which are the two third discharge opening arrays and the two second discharge opening arrays, wherein each of the two fourth discharge opening array units consists of only two discharge opening arrays which are the one second discharge opening array and the one first discharge opening array, and wherein the one fifth discharge opening array unit consists of only the two first discharge opening arrays.

13. The recording head according to claim 1, wherein each of the plurality of discharge opening array units includes one liquid chamber.

14. The recording head according to claim 1, wherein the plurality of discharge opening array units is provided in one chip.

15. The recording head according to claim 1, wherein the plurality of discharge opening array units is provided in a same nozzle plate.

16. A recording head comprising a plurality of discharge opening array units arranged side by side and including at least two first discharge opening array units for discharging a cyan ink, two second discharge opening array units for discharging a magenta ink, one third discharge opening array unit for discharging a light blue ink, and two fourth discharge opening array units for discharging a black ink, wherein the third discharge opening array unit is the only discharge opening unit, among the plurality of discharge opening array units, for discharging the light blue ink, and wherein the plurality of discharge opening array units is arranged in such a manner that the one third discharge opening array unit is located between the two first discharge opening array units, between the two second discharge opening array units, and not between the two fourth discharge opening array units.

17. An inkjet recording apparatus comprising:

a recording head comprising a plurality of discharge opening array units arranged side by side and including at least two first discharge opening array units for discharging an ink of a first color, two second discharge opening array units for discharging an ink of a second color, a third discharge opening array unit for discharging an ink of a third color, and two fourth discharge opening array units for discharging an ink of a fourth color; and control unit configured to control a recording operation by causing the recording head to discharge the inks, wherein $$h1<h3<h2,$$

$$L3>L1>L4, \text{ and}$$

$$L3>L2>L4$$

are satisfied, where h1 is a hue angle of the first color, L1 is a lightness of the first color, h2 is a hue angle of the second color, L2 is a lightness of the second color, h3 is a hue angle of the third color, L3 is a lightness of the third color, and L4 is a lightness of the fourth color, wherein the third discharge opening array unit is the only discharge opening unit, among the plurality of discharge opening array units, for discharging the ink of the third color, and wherein the plurality of discharge opening array units is arranged in such a manner that the one third discharge opening array unit is located between the two first discharge opening array units, between the two second discharge opening array units, and not between the two fourth discharge opening array units.

18. The inkjet recording apparatus according to claim 17, wherein the control unit controls the recording operation by causing the recording head to discharge the inks while the recording head performs forward and backward scans.

* * * * *